US009970737B2

(12) United States Patent
Andriot et al.

(10) Patent No.: US 9,970,737 B2
(45) Date of Patent: May 15, 2018

(54) OPTOPYROTECHNIC INITIATOR

(71) Applicant: COMMISSARIAT A L'ENERGIE ATOMIQUE ET AUX ENERGIES ALTERNATIVES, Paris (FR)

(72) Inventors: Patrick Andriot, Gradignan (FR); Francois Belin, La Brede (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 203 days.

(21) Appl. No.: 14/889,638

(22) PCT Filed: May 6, 2014

(86) PCT No.: PCT/EP2014/059261
§ 371 (c)(1),
(2) Date: Nov. 6, 2015

(87) PCT Pub. No.: WO2014/180860
PCT Pub. Date: Nov. 13, 2014

(65) Prior Publication Data

US 2016/0091287 A1 Mar. 31, 2016

(30) Foreign Application Priority Data

May 7, 2013 (FR) ..... 13 54195

(51) Int. Cl.
*F42C 19/00* (2006.01)
*F42B 3/113* (2006.01)

(52) U.S. Cl.
CPC ..... *F42B 3/113* (2013.01)

(58) Field of Classification Search
CPC ..... F42B 3/113
See application file for complete search history.

(56) References Cited

U.S. PATENT DOCUMENTS 3,799,055 A * 3/1974 Irish, Jr. ..... B25C 1/16 102/202.8
3,812,783 A 5/1974 Yang et al.
(Continued)

FOREIGN PATENT DOCUMENTS

EP 1 306 643 A1 5/2003
EP 1 742 009 A1 1/2007
(Continued)

OTHER PUBLICATIONS

International Search Report dated Jun. 13, 2014, in PCT/EP2014/059261 filed May 6, 2014.
(Continued)

*Primary Examiner* — Gabriel Klein
(74) *Attorney, Agent, or Firm* — Oblon, McClelland, Maier & Neustadt, L.L.P.

(57) ABSTRACT

An optical initiator of a pyrotechnic charge, including: a body including a cavity, which contains the pyrotechnic charge and a mechanism for igniting the charge by absorption of a laser radiation, the ignition mechanism being placed in contact with the charge; a laser radiation source; an optical fiber for transporting laser radiation from the source to the ignition mechanism. The ignition mechanism includes a metal plate and the metal plate and the laser radiation source are configured for a laser radiation issuing from the laser radiation source to be absorbed by the metal plate and converted into thermal energy, so that thermal conduction of the thermal energy from the metal plate to the pyrotechnic charge causes the ignition of the pyrotechnic charge. The metal plate can include perforations arranged periodically.

7 Claims, 2 Drawing Sheets

(56) References Cited

U.S. PATENT DOCUMENTS

| | | | | |
|---|---|---|---|---|
| 4,917,014 | A * | 4/1990 | Loughry | F42B 3/113 102/201 |
| 5,148,748 | A * | 9/1992 | Yarrington | F42B 3/113 102/201 |
| 2006/0096484 | A1 * | 5/2006 | Moulard | F42B 3/113 102/201 |
| 2007/0113941 | A1 * | 5/2007 | Moulard | C06B 33/08 149/92 |
| 2009/0151584 | A1 | 6/2009 | Desai et al. | |

FOREIGN PATENT DOCUMENTS

| | | |
|---|---|---|
| EP | 2 508 838 A1 | 10/2012 |
| WO | WO 98/05918 A1 | 2/1998 |

OTHER PUBLICATIONS

French Search Report dated Feb. 14, 2014, in FR Application 1354195 filed May 7, 2013.

* cited by examiner

OPTOPYROTECHNIC INITIATOR

TECHNICAL FIELD

The present invention relates to the field of pyrotechnic initiators, the initiation (or triggering) of which is triggered by light energy. These initiators are also known by the term optopyrotechnic initiators.

The invention finds an application in all fields where pyrotechnic initiators are used, in particular in the space and aeronautical fields as actuators, in safety equipment (valves, no-queue passes, etc.), etc.

STATE OF PRIOR ART

As is known, pyrotechnic initiators comprise, in a cavity, a pyrotechnic charge, which is in close contact with a means for igniting this charge.

The pyrotechnic charge may be, as required, an explosive composition or a pyrotechnic composition. In the first case, the initiator is generally referred to as a detonator; in the second case, the initiator is generally referred to as an igniter.

In the case of electrical pyrotechnic initiators and in particular in hot-wire initiators, the ignition means is an element consisting of an element (wire or layer) made from electrically conductive material, connected to an electricity generator. When a current passes through it, the element heats up by Joule effect and this heat is transmitted by thermal conduction to the pyrotechnic charge, which is in contact with the element. As an example of an electrical pyrotechnic initiator, document [1] can for example be cited.

The drawback of electrical initiators is that they are sensitive to electromagnetic interference and they may therefore be activated accidentally, by electrostatic discharges or induced currents due to parasitic electromagnetic radiations.

In the case of optopyrotechnic initiators, the pyrotechnic charge is now initiated not electrically but optically, making optopyrotechnic initiators insensitive to electromagnetic interference.

As is known, optopyrotechnic initiators comprise a pyrotechnic charge placed in a cavity, a laser radiation source and an optical fibre for guiding the laser radiation from the source to the charge.

The drawback of this type of initiator is that the pyrotechnic charges that are generally used for implementing detonators or igniters do not absorb laser radiations or do so only to a very small extent. It is therefore necessary to find a means for igniting these charges that is reactive to a laser source.

The solution proposed in document [2] consists of optically doping a pyrotechnic charge by introducing therein a powder of a metal material, thus making the modified charge able to absorb laser radiation and to heat up until it reaches its critical ignition temperature.

Another solution proposed in document [3], which specifically describes an initiator of the detonator type, consists of placing a layer of powder of a pyrotechnic composition optically doped with a powdery reducing metal, between the end of the optical fibre guiding the laser beam and the pyrotechnic charge, which is here a secondary explosive.

The main drawback of these two solutions proposing an optical doping is that it is difficult to find a balance in the sensitivity of the doped pyrotechnic composition, which must be sufficiently sensitive to effectively absorb the laser radiation but must not be too sensitive so as not to absorb parasitic thermal and infrared radiations and/or heating by thermal conduction.

Thus, though optopyrotechnic initiators appear to guarantee a better level of security than electrical pyrotechnic initiators, unwanted triggerings remain possible when the initiators are subjected to fluctuating thermal conditions.

DISCLOSURE OF THE INVENTION

The aim of the invention is therefore to at least partially remedy the drawbacks mentioned above relating to the embodiments of the prior art.

To do this, the subject matter of the invention is an optical initiator of a pyrotechnic charge, comprising:

- a body having a cavity in which the pyrotechnic charge is situated, and a means for igniting this charge by absorption of laser radiation, said ignition means being placed in contact with the charge;
- a laser radiation source;
- an optical fibre for guiding laser radiation from the source to the ignition means;

and characterised in that the ignition means is a metal plate, the metal plate and the laser radiation source being suitable so that laser radiation issuing from the laser radiation source is absorbed by the metal plate and converted into thermal energy, so that the thermal conduction of this thermal energy from the metal plate to the pyrotechnic charge causes ignition of the pyrotechnic charge.

The metal plate will absorb the laser radiation, convert the light energy of this absorbed radiation into thermal energy, and communicate this thermal energy to the pyrotechnic charge by thermal conduction. Thus, according to the principle of the invention, use is made of the light energy of a laser that is deposited in the metal plate, which is a material absorbent to the wavelength of the laser, which causes a very rapid increase to high temperature of the metal plate which, being in contact with the pyrotechnic charge, causes ignition of the charge.

The optopyrotechnic initiator that is the subject matter of the invention is particularly advantageous in that it combines the advantages of the electrical initiators and optical initiators of the prior art, without the drawbacks thereof, namely that the initiator according to the invention is insensitive to electromagnetic variations as well as to thermal variations. This is because the means for igniting the pyrotechnic charge, namely the metal plate absorbing the laser radiation, is pyrotechnically inert. As for the pyrotechnic charge, which, unlike the prior art, does not need to be optically doped, this is insensitive to laser radiation or only slightly so. It is therefore possible to use the same pyrotechnic charges as those that are normally used in electrical initiators.

The metal plate as a means for igniting the pyrotechnic charge affords narrow selectivity to the radiation capable of initiating the initiator, since it absorbs only the laser radiation, and specifically only in the ranges of wavelengths that can be absorbed by the metal or metal alloy constituting the metal plate. The safety of the initiator is therefore improved.

In general terms, the initiator according to the invention can either initiate an explosive or initiate a powder or a propellant, or finally initiate a pyrotechnic charge (smoke generator, etc.).

More particularly, the pyrotechnic charge may be a pyrotechnic composition (the optopyrotechnic initiator that is the subject matter of the invention then forming an igniter) or an explosive composition (the initiator then being a detonator).

The pyrotechnic compositions may for example be chosen from illuminating, tracing, smoke-generating etc. compositions.

The explosive compositions may for example be primary explosives such as azides, fulminates, tetrazenes, etc., secondary explosives such as pentaerythrite tetranitrate (PETN), cyclotrimethylenetrinitramine (RDX), hexanitrostilbene (HNS), etc.

Preferably, the metal plate has a plurality of perforations. This reduces the metal mass to be heated and thus increases the speed of heating of the metal plate without impairing—by reducing it excessively—the surface by which the plate makes contact with the pyrotechnic charge.

Advantageously, the perforations are arranged periodically so as to define, in the metal plate, a plurality of identical elements connected together by bridges. The purpose of this periodic perforation is to reduce the size of the metal plate (target) that the laser is to heat by isolating the elements (sub-targets) between which the thermal conduction is minimised by the bridges, the role of which is to provide structuring and cohesion of all the sub-targets in a single entity. The advantage of the sub-targets is to reduce the metal mass to be heated and, consequently, to reduce the heating time and therefore to increase the ignition dynamics of the pyrotechnic charge. In addition, as the perforation pattern is repeated over the entire metal plate, periodic perforation also has the advantage that any misalignment of the focal spot of the laser beam on the metal plate does not have a significant influence on the heat transfer.

The bridges reduce the thermal conduction between the elements (sub-targets). The bridges have a width that is significantly less than the largest dimension of the perforations.

According to one embodiment envisaged, the perforations are situated at the vertices of contiguous hexagons, preferably disposed so as to form a honeycomb pattern. The advantage of a honeycomb pattern is that this particular geometry optimises the size of the sub-targets and therefore optimises the global efficacy of the target.

It should be noted that, since the metal plate is the means for igniting the pyrotechnic charge by absorption of the laser radiation, it is obvious that the metal or metal alloy forming the plate must be absorbent to the wavelength of the laser. Advantageously, the metal plate is a metal chosen from platinum, gold, tungsten or an alloy of at least two of these metals. More generally, heavy metals will be chosen for which the specific heat and density have an advantage for heating the target and for which the capacity by absorption of the radiation is more favourable than for other metals, in particular in the UV range. This is the reason why it will be preferred to avoid using iron and aluminium since they do not have good absorption-capacity characteristics.

Advantageously, the optical initiator further comprises a lens for focusing the laser radiation that is interposed between the first end of the optical fibre and the ignition means, the other end of the optical fibre being connected to the source of laser radiation, this focusing lens being chosen from a spherical lens and a cylindrical (bar) lens. By improving the focusing of the laser beam on the metal plate, the efficacy of the pyrotechnic initiation is improved.

Preferably, the plate has a thickness of between 0.02 mm and 0.1 mm, the fineness of the plate allowing the metal mass to be heated to be reduced and therefore obtaining a more rapid variation in temperature. Preferably, the plate has a diameter of around three millimeters corresponding approximately to the size of the primary explosive detonator.

According to one envisaged embodiment, the plate is covered with a dichroic coating. This improves the absorption of the laser radiation by the plate by maximising the absorption capacity of the metal plate to the laser radiation of the laser source and limiting the reflectivity of the metal plate, which in the end increases the efficiency of the energy transfer from the laser source to the metal plate and from the metal plate to the pyrotechnic charge. The dichroic coating on the metal plate can be obtained by vapour deposition of one of more suitable metals on the part of the plate exposed to the laser beam (for example metals having a coefficient of absorption of laser radiation greater than that of the metal plate).

The laser source and the optical fibre are the same as those normally used in the optical initiators of the prior art. The laser source may be a laser diode, this type of source having the advantage of being very compact. The laser source may emit in the infrared (that is to say in the range from 1000 μm to 700 nm), but it will be preferred to use a laser source emitting an ultraviolet radiation (that is to say in the range from 400 nm to 200 nm), UV radiation generally being better absorbed by metals than IR radiation.

Other advantages and features of the invention will emerge from the following non-limitative detailed description.

BRIEF DESCRIPTION OF THE DRAWINGS

This description will be given with regard to the accompanying drawings, among which.

DETAILED DISCLOSURE OF PARTICULAR EMBODIMENTS

Figure 1:
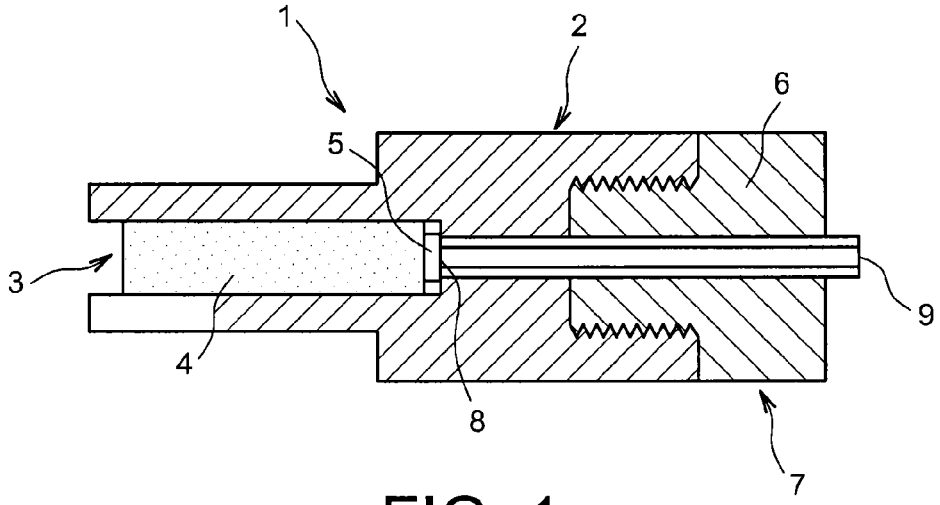
FIG. 1 depicts a schematic view in longitudinal section of an optical initiator according to the invention.

With reference to FIG. 1, this shows an initiator 1 that comprises a body 2 provided with a cavity 3, wherein there are disposed a pyrotechnic charge 4 and a metal plate 5 placed in contact with the charge.

An optical fibre 6 guides a laser beam from a laser source (not shown) towards the metal plate 5.

In a known fashion, a connecting piece 7 serves as a support for the optical fibre 6 and thus makes it possible to place one end 8 of the optical fibre in contact with the metal plate 5, the other end 9 being connected to the laser source. The connecting piece here has a thread facilitating connection thereof to the body 2.

It is also possible to improve the focusing of the laser beam on the metal plate and thus to increase the efficacy of the optopyrotechnic initiation by placing a focusing lens (not shown) between the end 8 of the optical fibre and the metal plate 5.

In a known fashion, the initiator may serve to form a pyrotechnic chain, the body of the initiator then forming the first stage of the chain, the second, third, etc. stages of the pyrotechnic chain comprising pyrotechnic charges less and less sensitive and more and more energetic than the charge of the initiator.

Since a laser beam is a coherent beam forming a small-diameter laser spot, the metal plate does not need to be large.

In fact, it is preferable for the plate to be small in order to accelerate heating thereof by the laser beam. It is however preferable for the size of the plate to be sufficiently great for it to be easy to align the laser beam on the plate. Likewise, the smaller the thickness of the plate, the more rapidly is this thickness heated by the laser beam and the less easily manipulatable is this plate. In the end, the choice of the dimensions of the metal plate is a compromise between speed of heating of the metal plate, the ease of alignment of the laser beam and the ease of manipulation of the metal plate. For example, for a laser beam having a laser spot 1 mm in diameter, a metal plate having the form of a pellet approximately 3 mm in diameter and a thickness of approximately eighty hundredths of a millimeter can be chosen.

It should be noted that the thickness of the metal plate also depends on the power of the laser source that is used.

In preferred embodiments of the invention, the metal plate comprises multiple perforations arranged periodically. Two examples of possible geometries of perforations are illustrated in FIGS. 2 and 3.

Figure 2:
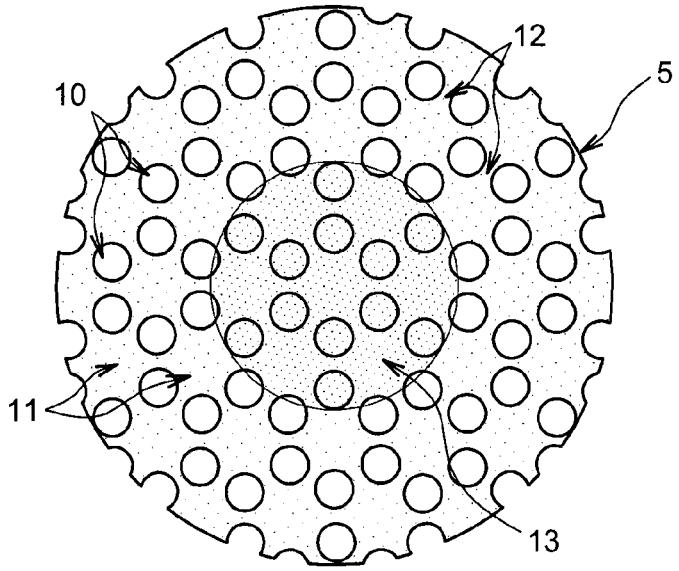
FIG. 2 depicts a front view of a multiperforated plate according to a first preferred embodiment of the present invention.

With reference to FIG. 2, the metal plate 5 is a circular-shaped pellet, and the perforations 10 are circular and identical and are situated at the vertices of contiguous hexagons forming a honeycomb structure. In this way identical elements 11 are obtained, connected together by bridges 12 or ligaments of material. The central spot 13 represents a circular focal spot, which may for example be obtained by using a spherical lens.

Figure 3:
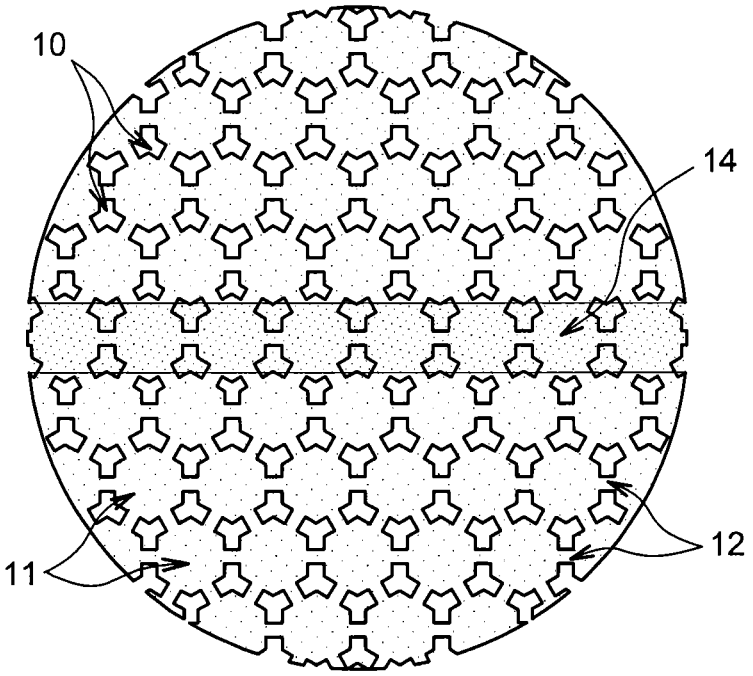
FIG. 3 depicts a front view of a multiperforated plate according to a second preferred embodiment of the present invention.

Another possible architecture of the perforations is shown in FIG. 3, in which, unlike FIG. 2, the perforations 10 have a form resulting from the intersection of three branches, each branch following the direction of a hexagon wall. The central bar 14 represents the area of impact of the laser on the plate, which is here a rectangular focal spot that can be obtained by passing the laser beam through a cylindrical lens for example.

The perforations can be obtained by proceeding with a laser machining or by photoetching of the metal plate. It should be noted that the circular form of the perforations in FIG. 2 is easier to achieve than the perforations in FIG. 3.

The objective of the perforation of the plate is to reduce the surface area of the plate that the laser beam must heat by isolating elements 11 between which the thermal conduction is minimised by bridges 12, the role of which is to provide the structuring and cohesion of all the elements 11 in a single plate 5. The advantage of the elements 11 thus obtained in the plate 5 is to reduce the metal mass to be heated and consequently to reduce the heating time and therefore to increase the ignition dynamics of the pyrotechnic charge in contact with the plate 5. The multiplicity of elements 11 that are heated also increases the number of grains of the powder that constitutes the pyrotechnic charge, which are raised to the ignition temperature, that is to say the temperature at which they react. The pyrotechnic initiation of the pyrotechnic charge is thus less punctiform and more homogeneous, which increases the reliability of initiation and reduces the risks of long fire.

Another advantage of the periodic multi-perforation is that, as the perforation patterns are repeated over the entire surface of the plate, the elements 11 and the bridges 12 are all identical. Consequently a misalignment of the focal spot does not significantly influence the heat transfer. For example, in FIG. 2, seven elements 11 or sub-targets are illuminated by the focal spot of the laser beam (the non-illuminated elements 11 not being heated, because of the presence of the bridges 12, which limits the thermal conduction). A misalignment of this focal spot would mean that it would still illuminate the equivalent of seven sub-targets. Thus, even in the case of optical misalignment, the pyrotechnic composition would be heated in the same way. In FIG. 3, there are eight elements that are illuminated and, even in the case of axial or angular misalignment of the laser beam, eight sub-targets always remain illuminated.

CITED REFERENCES

[1] EP 2 508 838 A1
[2] EP 1742 009 A1
[3] FR 2 831 659 A1

The invention claimed is:

1. An optical initiator of a pyrotechnic charge, comprising:

a body including a cavity in which the pyrotechnic charge is situated;

an ignition means for igniting the charge by absorption of a laser radiation, the ignition means being placed in contact with the charge;

a laser radiation source;

an optical fiber for guiding a laser radiation from the source to the ignition means; and wherein the ignition means includes a metal plate that includes a plurality of perforations, the metal plate and the laser radiation source being configured so that a laser radiation issuing from the laser radiation source is absorbed by the metal plate and converted into thermal energy, so that thermal conduction of the thermal energy from the metal plate to the pyrotechnic charge causes ignition of the pyrotechnic charge.

2. An optical initiator according to claim 1, wherein the perforations are arranged periodically to define, in the metal plate, a plurality of identical elements connected together by bridges.

3. An optical initiator according to claim 1, wherein the metal plate is made from a metal chosen from platinum, gold, tungsten, or an alloy of at least two of these metals.

4. An optical initiator according to claim 1, further comprising a lens for focusing the laser radiation that is interposed between a first end of the optical fiber and the ignition means, a second end of the optical fiber being connected to the laser radiation source, the focusing lens being chosen from a spherical lens and a cylindrical lens.

5. An optical initiator according to claim 1, wherein the plate has a thickness of between 0.02 mm and 0.1 mm.

6. An optical initiator according to claim 1, wherein the plate is covered with a dichroic coating.

7. An optical initiator according to claim 1, wherein the laser source emits ultraviolet radiation.

* * * * *